US007342848B2

(12) United States Patent
Haugh

(10) Patent No.: US 7,342,848 B2
(45) Date of Patent: Mar. 11, 2008

(54) LAP TIMER

(75) Inventor: Peter Haugh, Oak Hill, VA (US)

(73) Assignee: Lapster, LLC, Potomac, MD (US)

( * ) Notice: Subject to any disclaimer, the term of this patent is extended or adjusted under 35 U.S.C. 154(b) by 80 days.

(21) Appl. No.: 11/036,104

(22) Filed: Jan. 18, 2005

(65) Prior Publication Data

US 2005/0174892 A1 Aug. 11, 2005

Related U.S. Application Data

(60) Provisional application No. 60/536,517, filed on Jan. 15, 2004.

(51) Int. Cl.
*G04F 8/00* (2006.01)

(52) U.S. Cl. ..... 368/107; 368/113

(58) Field of Classification Search ..... 368/107, 368/113, 110, 89, 112
See application file for complete search history.

(56) References Cited

U.S. PATENT DOCUMENTS

| | | | | | |
|---|---|---|---|---|---|
| 4,352,064 | A * | 9/1982 | Dunn | 324/178 |
| 4,592,001 | A * | 5/1986 | Willard | 702/149 |
| 4,797,864 | A * | 1/1989 | Stano et al. | 368/111 |
| 5,163,014 | A * | 11/1992 | Calimeri | 702/149 |
| 5,696,706 | A * | 12/1997 | Morton et al. | 702/142 |
| 6,366,540 | B1 * | 4/2002 | Kaminsky | 368/228 |
| 2004/0190380 | A1 * | 9/2004 | Wojcieszak | 368/69 |
| 2004/0213087 | A1 * | 10/2004 | Gillette et al. | 368/107 |

* cited by examiner

*Primary Examiner*—Ren Yan
*Assistant Examiner*—Leo T Hinze
(74) *Attorney, Agent, or Firm*—Dickstein Shapiro LLP

(57) ABSTRACT

The invention relates to an electronic timing device. The timing device has several modes including Basic mode and Lap mode. Additionally, the timing device computes the speed of an item being timed. Further, the outside of the device is designed to display information, including advertisements.

18 Claims, 5 Drawing Sheets

LAP TIMER

This application claims the benefit of provisional application Ser. No. 60/536,517, filed Jan. 15, 2004.

BACKGROUND OF THE INVENTION

1. Field of the Invention

The invention relates generally to a handheld timing device and more particularly to a timing device that calculates the speed of an item traveling a set distance. Further, the timing device housing is designed for displaying information, and more particularly, advertising.

2. Background

Handheld timers or stopwatches have for years been used to time a participant traveling a specific distance. At racing events, e.g. car racing, the time it takes to travel a distance often means the difference between winning and losing. At auto-racing events, often the car speed and lap timed are not displayed. At many speedways only the leaders are displayed on a board. Fans or spectators do not therefore, know the speed or time it takes a participant to complete a lap, the entire race, or even a pit stop. Accordingly, an inexpensive, easily operable timer is desired for timing laps and calculating the speed of vehicles traveling a lap. Additionally, it may be desired by an advertiser to employ an inexpensive timer housing to display information or advertising.

BRIEF SUMMARY OF THE INVENTION

The invention relates to an electronic timing device. The timing device has several modes including a Basic mode and a Lap mode. Additionally, the timing device computes the speed of an item being timed. Further, the outside of the device is designed to display information, including advertisements.

BRIEF DESCRIPTION OF THE DRAWINGS

The foregoing and other advantages and features of the invention will become more apparent from the detailed description of exemplary embodiments provided below with reference to the accompanying drawings in which.

DETAILED DESCRIPTION OF THE INVENTION

In the following detailed description, reference is made to the accompanying drawings, which are a part of the specification, and in which is shown by way of illustration, various embodiments whereby the invention may be practiced. These embodiments are described in sufficient detail to enable those skilled in the art to make and use the invention. It is to be understood that other embodiments may be utilized, and that structural, logical, and electrical changes, as well as changes in the materials used, may be made without departing from the spirit and scope of the present invention.

Figure 1:
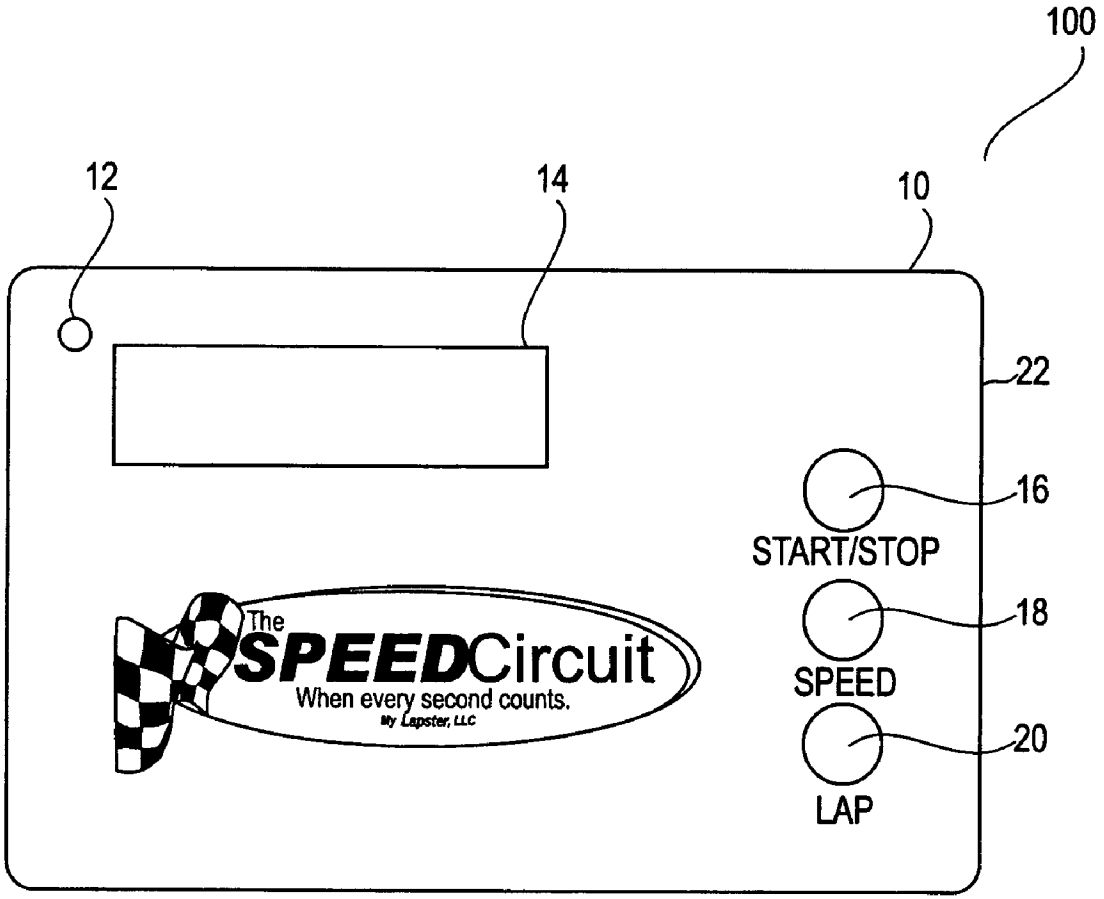
FIG. 1 illustrates an exemplary outer view of a timing device according to the present invention.
Figure 2:
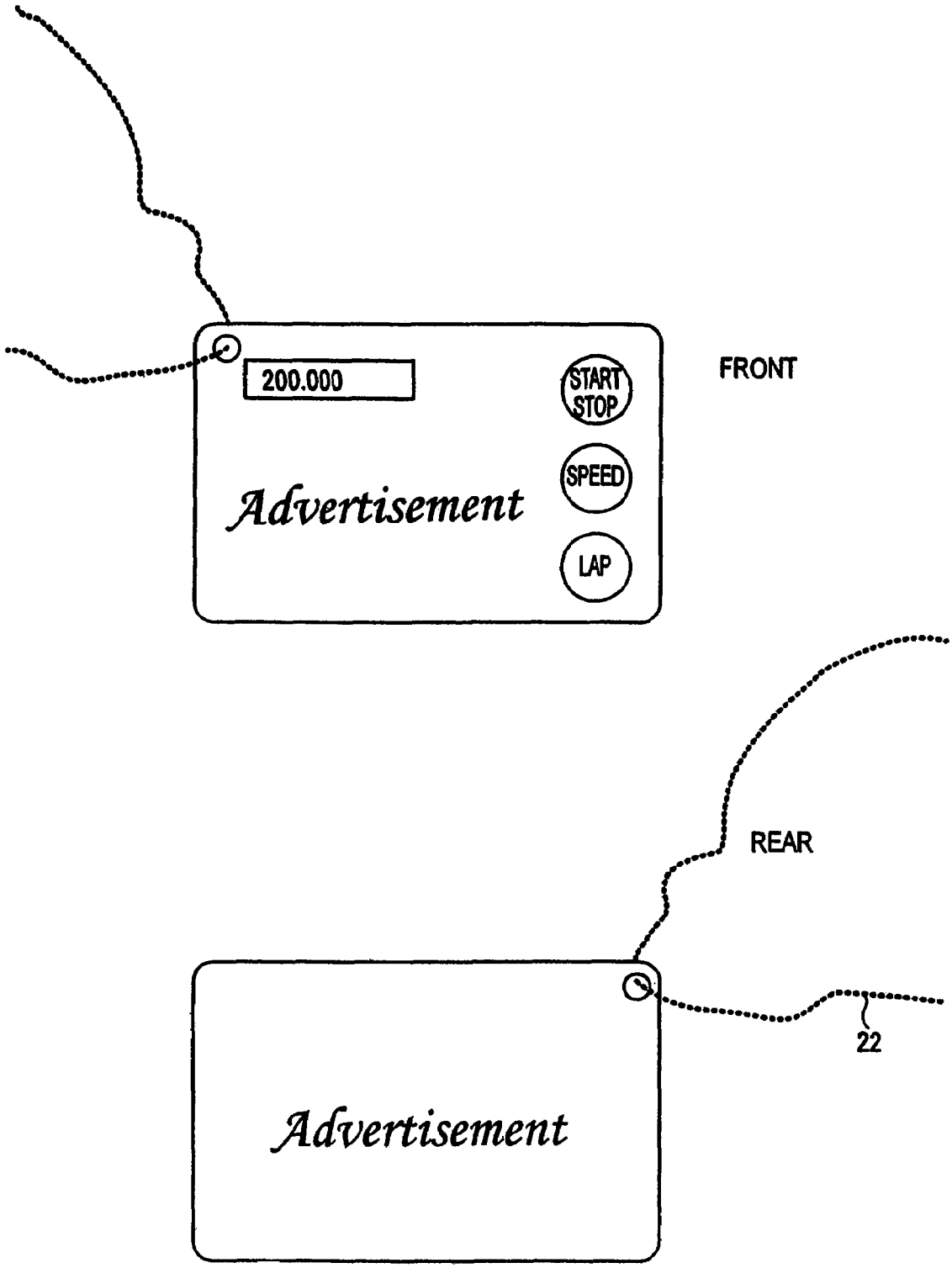
FIG. 2 illustrates an exemplary outer view of the timing device displaying advertising on the front and rear of the timing device.

The invention relates to an electronic timing device. FIG. 1 illustrates an exemplary outer view of the timer 100. The timer 100 is constructed of any conventionally known material that forms a sturdy housing 10, such as plastic. The housing 10 is designed to display advertising or other information on the front and back of the timer 100, as illustrated in FIG. 2. Advertisements can be adhered to the timer 100 after manufacturing or they can be incorporated into the manufacturing process. In an exemplary embodiment, the timer housing 10 is flat and thin for displaying the advertisements. The housing 10 is constructed such that it has a hole 12 going through it for allowing a lanyard 22 or other material to be looped to the housing 10. The LCD screen 14 may display the running timer, a timed period and the speed calculated by the timer 100, as well as the track length. The housing 10 has a Start/Stop button 16, a Speed button 18, and a Lap button 20. Additionally, the timer has a Reset feature 22.

Figure 5:
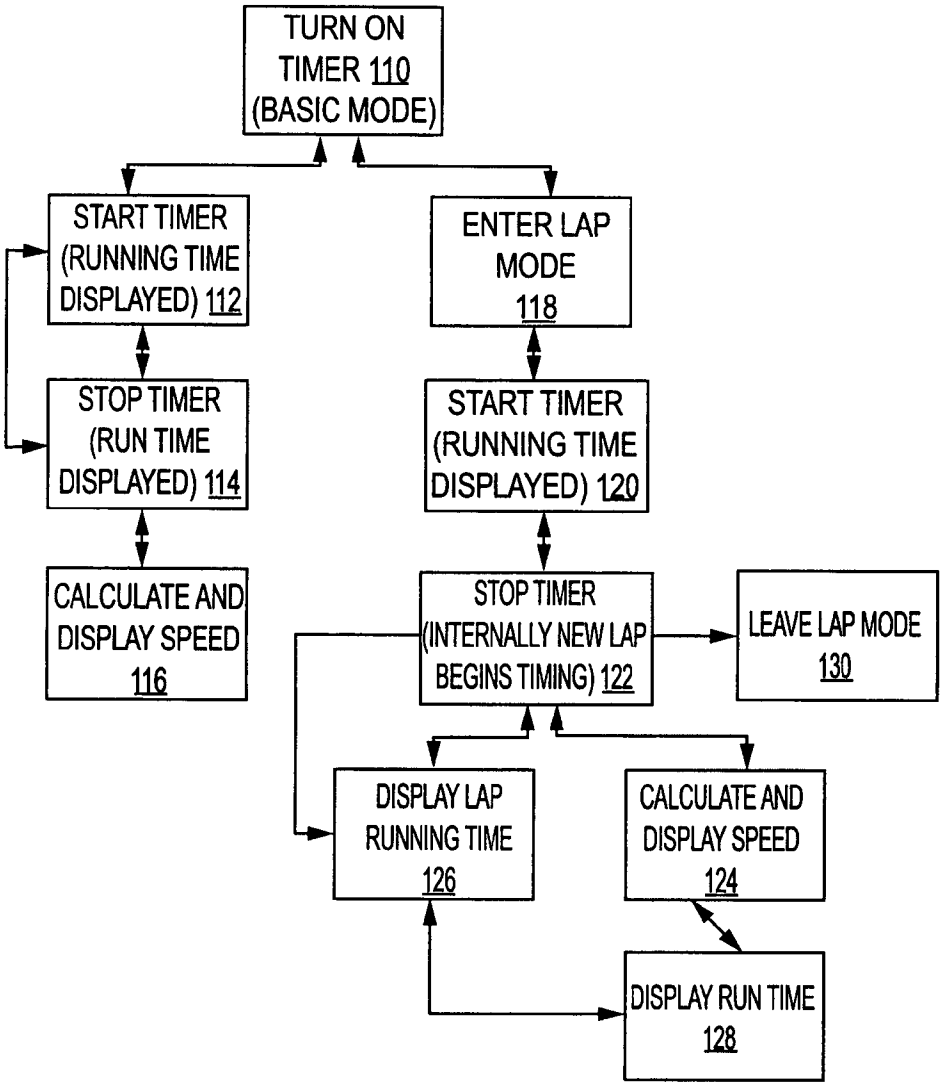
FIG. 5 illustrates an exemplary flow chart of an embodiment of the invention.

FIG. 5 illustrates the exemplary timer functions. When the timer 100 is turned on (step 110), by pressing any button, "000.000" is displayed on the screen 14. This indicates to the user that the timer 100 is on but is not running. The timer has two different modes: Basic mode and Lap mode. When the timer 100 is first turned on, it starts in the Basic mode. In the Basic mode, when the Start/Stop button 16 is pressed, the timer clock, displayed on the display 14, begins to run (step 112). In step 114, when the Start/Stop button 16 button is pressed again, the clock stops running and the elapsed time continues to appear in the display until the speed button is pressed, the sleep mode is initiated (not shown), or the user begins timing again (i.e., by pressing the Start/Stop button 16). After the clock is stopped in step 114, the user can press the Speed button 18 to calculate the speed of the timed item (step 116) based on either a default distance stored by the timer 100, or a distance previously entered by the user. An exemplary use of the timer is at a race track, so the distance stored in the timer is the track length. Thereby, the speed calculated is displayed in MPH (if the distance was entered in miles or units thereof); however, the unit of measure could be changed (prior to manufacturing) and implemented during manufacturing. Thus it becomes imperative that the user input a distance in the units that the timer is implementing. When the Speed button 18 is pushed in step 116, the internal clock is reset to zero and the speed is calculated and displayed accurately to three decimal places. When the speed is displayed, an icon indicating the unit of measure (e.g., MPH) appears. The unit icon also indicates to the user that the value displayed on the LCD 14 is the speed and not the elapsed time. Next, if the Start/Stop button 16 is pushed, the clock begins to run again beginning from zero and the timing cycle begins again (step 112).

In Basic mode, when the Lap button 20 is pressed in step 118, the timer 100 changes to LAP mode and a LAP icon appears in the display 14. By pressing the Start/Stop button 16 in step 120, the clock starts running. When the button 16 is pressed again in step 122, the clock stops running in the display 14; however, internally the clock is returned to zero and begins timing the next lap. The user is reminded that the next lap is being timed because the SPLIT icon is flashing on the display 14. If the user takes no action for several seconds, the display 14 will switch back to the running time (step 126). When the speed button 18 is depressed, the speed is calculated and displayed accurately to three decimal places (step 124). If SPLIT is flashing, the timer is indicating that internally the next lap is still being timed. Next, if the Stop/Start 16 button is pressed yet again in step 128, the display shows the running elapsed time for the prior lap. If Start/Stop 16 is pressed again the running time is displayed (step 126). The SPLIT icon no longer flashes on the screen, but the LAP icon is still illuminated indicating that the timer remains in the Lap mode. Pressing the Start/Stop 16 button again stops the clock running in the display (step 122) but again, internally the timer has returned to zero and is timing the next lap. In order to reset the timer while in the Lap mode, if after the clock is stopped, the Start/Stop button 16 is pushed again, prior to the SPEED button being pushed, and the timer then resets. To exit the Lap mode, the user must hold down the Lap button for several seconds (step 130).

The distance/track length used to calculated the speed is preset. However, the track length may be preset to any predetermined length and can be changed during manufacture. Additionally, the user may set the track length by holding down the LAP key for a set predetermined number of seconds (e.g., 8 seconds) and the currently stored track length will begin to flash on the display 14. The user may input a new track length using the Start/Stop and Speed buttons 16, 18. For example, the timer 100 may allow the user to select the Start/Stop button 16 to set the first number from 1-9, and press the Speed button 18 to move to the next digit. If there is no input for a predetermined length of time (e.g., 5 seconds), the display 14 will return to the main display, or the user can simply press the LAP button 20 to return to the main screen. If the user wants to adjust the track length, they should do so before they begin timing so that the speed calculation is accurate.

The timer includes a Reset button 22. The Reset button 22 returns the user to Basic mode with the preset default track length and the timer and speed returning to a zero value. The preferred embodiment implements the timer with a non-replaceable battery for powering the timer 100. The timer, however, can be implemented using solar power or some other known form of portable energy. The timer does not require an On/Off switch because the unit has a Sleep mode. It is contemplated that an On/Off switch could be included. The Auto Sleep mode turns off the timer after a predetermined period of time without input from a user, regardless of the mode. If the timer turns off and the track distance had been changed, the new value will remain until the Reset button 22 is pressed.

Figure 3:
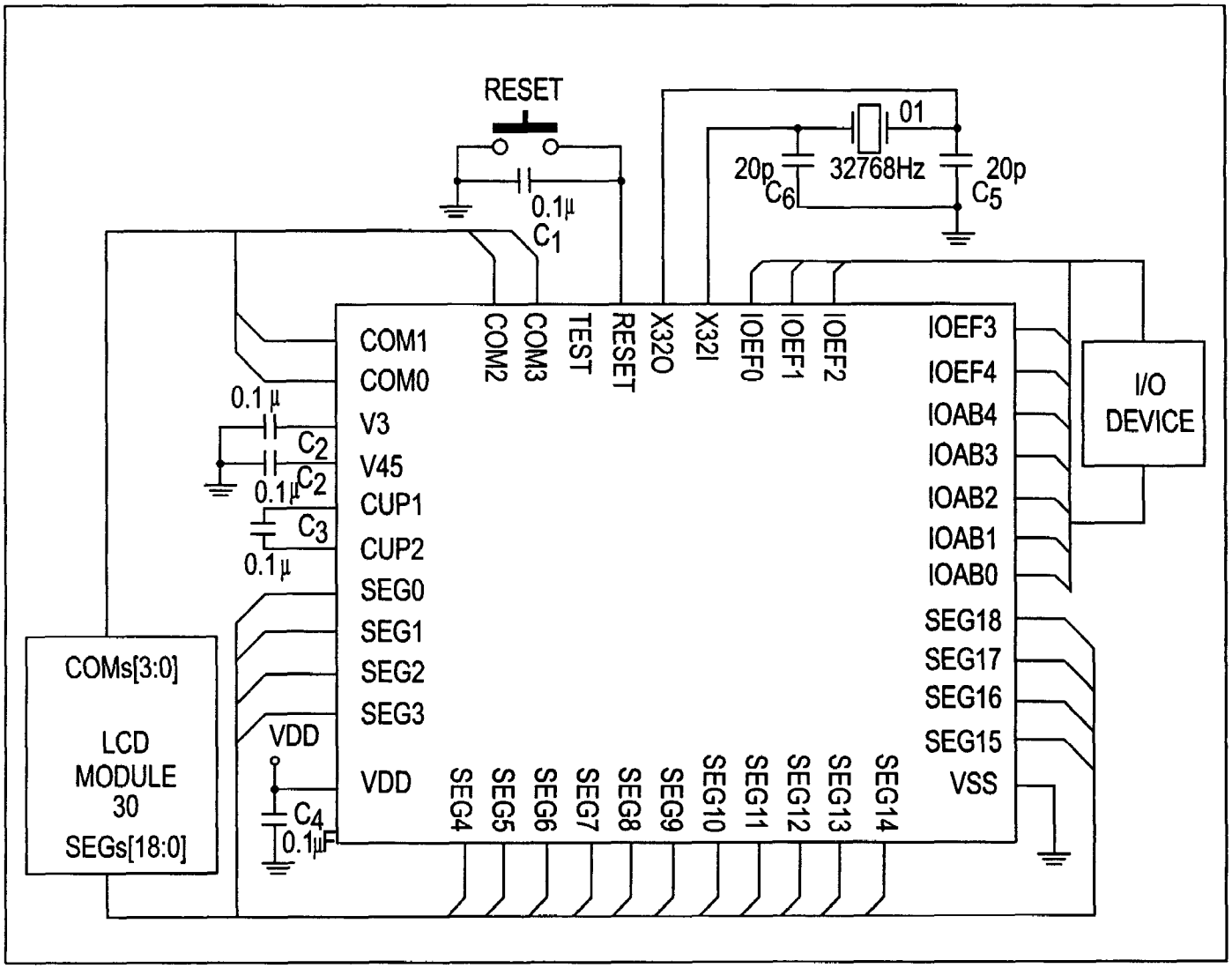
FIG. 3 illustrates an exemplary circuit diagram according to an embodiment of the invention.

FIG. 3 illustrates an exemplary circuit diagram of the invention. SEG pins SEG0 through SEG 18 are connected to the LCD Module. COM pins COM0 through COM3 are also connected to the LCD Module 30. The RESET pin is connected to a push switch and a 1 μF capacitor C1 which, in turn, are connected to ground. IOEF pins through IOEF4 and IOAB pins IOAB0 through IOAB4 are connected to an I/O device. VSS is connected to ground. VDD is connected to a VDD and a 0.1 μF capacitor C4 which in turn is connected to ground. CUP1 and CUP2 are coupled together via a 0.1 μF capacitor C3. V3 and V45 are connected to a pair of 0.1 μF capacitors C2, C3. The parallel capacitors C2 and C3 are connected to ground. X32O and X32I are connected to an oscillator O1 for regulating the timing functions. Connected on either side of the oscillator O1 are two 20 pF capacitors C5, C6. Capacitors C5 and C6 are connected to ground.

Figure 4:
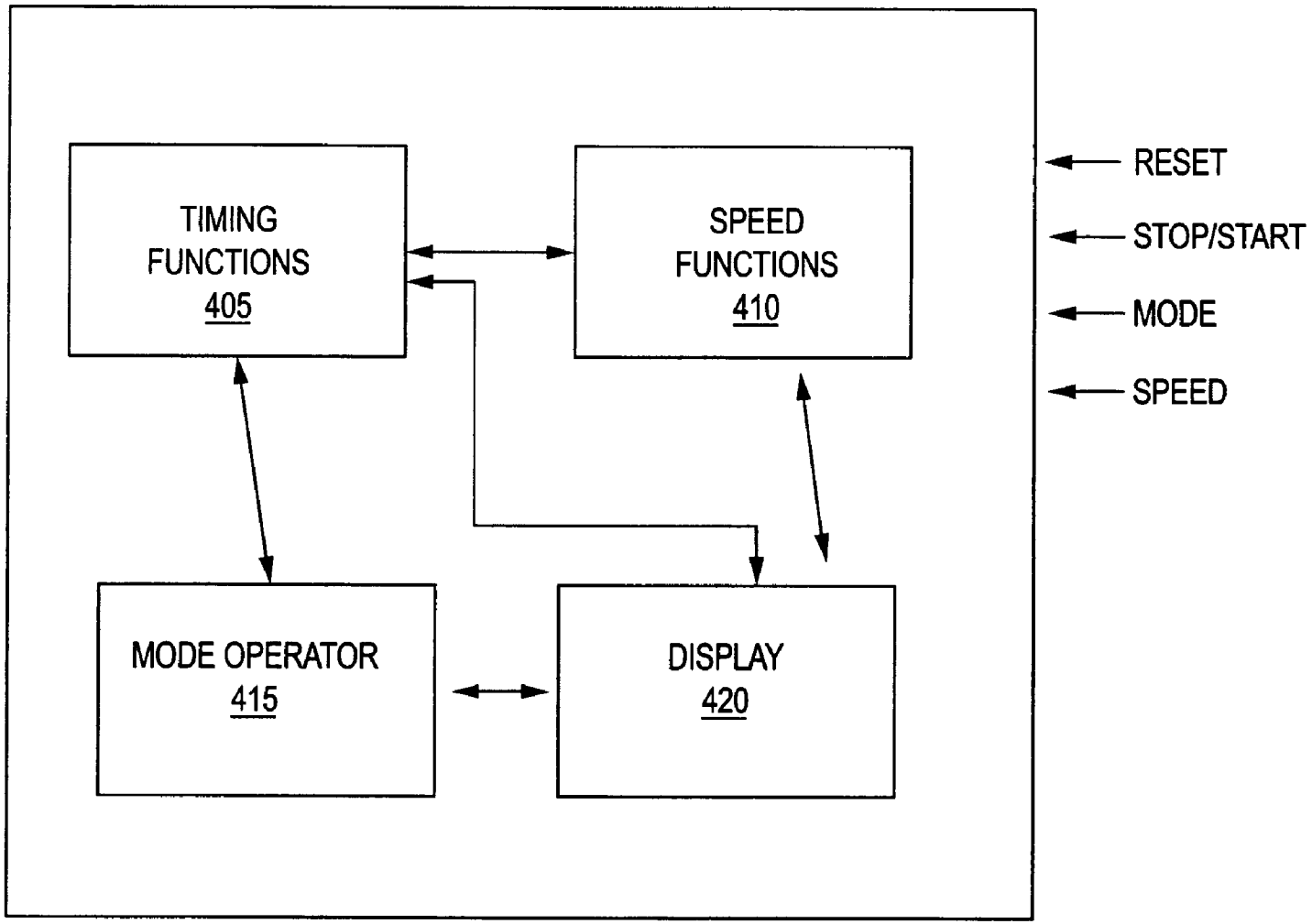
FIG. 4 illustrates an exemplary block diagram of an embodiment of the invention.

FIG. 4 illustrates a block diagram of the functions of the above described timer. The timing functions 405, such as initiating and stopping the timer, communicate with the display 420. Display 420, including LCD Module illustrated in FIG. 3, displays the output of the timing functions 405, speed functions 410 and the mode 415. The timing functions 405 also communicate with the speed functions 410 to provide the time that is used during speed calculations. The mode operator 415 communicates with the timing function 405 and the display 420. Mode 415 changes the mode of the timer, as described with regard to FIG. 1.

Although the above described timer implements multiple modes and features, the invention is contemplated with other circuits configurations which allow a user to time an item, have a distance stored in the timer and calculate the speed accordingly. The mode operations described herein are only exemplary. The present invention can be implemented using any arrangement of conventionally known circuitry available to one of ordinary skill in the art.

The processes and devices described above illustrate exemplary methods and devices of many that could be used to implement the invention. The above description and drawings illustrate exemplary embodiments of the present invention. However, it is not intended that the present invention be strictly limited to the above-described and illustrated embodiments and is only limited by the scope of the appended claims.

What is claimed as new and desired to be protected by Letters Patent of the United States is:

1. A hand-held electronic timing device system comprising:

a housing for said timing device, wherein said housing displays information;

a display for displaying time, mode, distance and speed information;

a first button for initiating and stopping a timing function;

a second button for placing the timer in a different mode;

a third button which initiates speed calculations; and a circuit configured to act as a timing device and for calculating said speed.

2. The timer according to claim 1, wherein said housing is formed in a thin flat rectangular shape.

3. The timer according to claim 1, further comprising a reset button for setting the timer to zero and a distance to a default value.

4. The timer according to claim 1, wherein said displayed information is advertising.

5. The timer according to claim 1, further comprising a preset distance value used in said speed calculation.

6. The timer according to claim 5, wherein said distance value can be altered.

7. The timer according to claim 1, wherein said timer is automatically turned off after a set period of time without any use.

8. A method for operating a timer comprising:

pressing a first button to start a timer to time an item;

pressing the first button again to stop the timer;

pressing a second button to calculate the speed of the item being timed and display said speed.

9. The method according to claim 8, further comprising turning off said timer when said timer has been idle for a predetermined period of time.

10. The method according to claim 8, further comprising setting a distance for use in calculating said speed.

11. The method according to claim 10, further comprising the steps of:

initiating a distance setting mode using a third button setting a first digit using said first button;

moving to a next digit by using said second button;

setting said next digit by using said first button;

exiting said distance setting mode using said third button or remaining idle for a set period.

12. The method according to claim 8, further comprising entering lap mode by pressing a third button.

13. The method according to claim 12, wherein operating in lap mode includes:

pressing the third button after the timer has begun to run and a first lap is completed;

displaying the time of said first lap;

resetting an internal lap counter and begin timing a next lap;

displaying said timed time of said first lap;

stopping said timing; and pressing said third button to exit lap mode.

14. The method of claim 13, further comprising displaying said lap speed by pressing said second button.

15. The method according to claim 8, further comprising resetting said timer by pressing a reset button.

16. The method according to claim 8, further comprising displaying at least one advertisement on said timer.

17. A method for operating a lap timer comprising:

pushing a third button to enter a track length setting mode;

setting a first digit by pushing a first button;

moving to a next digit by pushing a second button;

setting the second digit by pressing the first button;

exiting the track length setting mode by pushing the third button or not pushing any buttons for a predetermined period of time;

starting the timer by pushing the first button;

stopping the timer and displaying a timed time by pushing the first button;

calculating a speed of an item being timed and displaying said speed by pushing the second button.

18. The method of claim 17, wherein entering the track length setting mode comprises holding down the third button for a predetermined period of time.

* * * * *